US011492845B2

(12) United States Patent
Cheng

(10) Patent No.: US 11,492,845 B2
(45) Date of Patent: Nov. 8, 2022

(54) CONTROL DEVICE FOR A WINDOW BLIND

(71) Applicant: Ching-Hsiang Cheng, Tainan (TW)

(72) Inventor: Ching-Hsiang Cheng, Tainan (TW)

( * ) Notice: Subject to any disclaimer, the term of this patent is extended or adjusted under 35 U.S.C. 154(b) by 57 days.

(21) Appl. No.: 17/025,929

(22) Filed: Sep. 18, 2020

(65) Prior Publication Data

US 2021/0087881 A1 Mar. 25, 2021

(30) Foreign Application Priority Data

Sep. 20, 2019 (TW) ..... 108134067

(51) Int. Cl.
*E06B 9/78* (2006.01)
*E06B 9/42* (2006.01)

(52) U.S. Cl.
CPC ..... *E06B 9/78* (2013.01); *E06B 9/42* (2013.01); *E06B 2009/785* (2013.01)

(58) Field of Classification Search
CPC ..... E06B 9/78; E06B 2009/785; E06B 9/42; E06B 9/40; E06B 9/56; F16D 7/06; F16D 7/08; F16D 43/204; F16D 43/206
See application file for complete search history.

(56) References Cited

U.S. PATENT DOCUMENTS

2002/0048083 A1* 4/2002 Okumura ..... G03B 21/56 359/461
2002/0153219 A1* 10/2002 Chen ..... B25B 23/141 192/56.62
2006/0191650 A1* 8/2006 Takebayashi ..... E06B 9/78 160/320
2009/0308547 A1* 12/2009 Kwak ..... E06B 9/42 160/368.1
2011/0209836 A1* 9/2011 Yu ..... E06B 9/322 160/305
2012/0266413 A1* 10/2012 Kao ..... E06B 9/42 16/96 D
2015/0354275 A1* 12/2015 Huang ..... E06B 9/32 160/368.1
2015/0368966 A1* 12/2015 Faller ..... E06B 9/90 160/311
2016/0017964 A1* 1/2016 Yu ..... F16H 19/001 160/168.1 P
2016/0281423 A1* 9/2016 Kao ..... E06B 9/42
2017/0362890 A1* 12/2017 Huang ..... E06B 9/34
2018/0179812 A1* 6/2018 Dubina ..... E06B 9/264
2019/0153777 A1* 5/2019 Byun ..... E06B 9/90

* cited by examiner

*Primary Examiner* — Johnnie A. Shablack
*Assistant Examiner* — Matthew R. Shepherd
(74) *Attorney, Agent, or Firm* — Muncy, Geissler, Olds & Lowe, P.C.

(57) ABSTRACT

A control device for coupling with a shaft of a window blind and controlling rotation of the shaft includes first and second ratchet seats, a spool assembly operable to rotate in unwinding and winding directions, a tubular case, an output unit coupled with the shaft, and a transmission unit operable to be shifted between a transmitting state to have a torque transmitted to the output unit, and a non-transmitting state to interrupt the torque transmission. Each ratchet seat has a surrounding groove and teeth. Balls are rollably engaged in the surrounding groove and the spool assembly for permitting rotation of the first ratchet seat with the spool assembly in the unwinding direction, and not to rotate the first ratchet seat in the winding direction.

10 Claims, 14 Drawing Sheets

CONTROL DEVICE FOR A WINDOW BLIND

CROSS-REFERENCE TO RELATED APPLICATION

This application claims priority of Taiwanese Patent Application No. 108134067, filed on Sep. 20, 2019.

FIELD

The disclosure relates to a window blind, and more particularly to a control device for controlling rotation of a shaft of a window blind to roll a curtain.

BACKGROUND

Referring to FIGS. 1 to 3, a conventional control device for a window blind disclosed in Taiwanese Patent No. M509003 includes a spool 12 for winding a pulling cord 11, a coil spring 13 disposed inside the spool 12, a first axle 14 coupled to be driven by the spool 12, a second axle 15 coaxially coupled to the first axle 14, first and second springs 161, 162 sleeved around the second axle 15, first and second sleeves 17, 18 respectively sleeved around the first and second springs 161, 162, and a coupler 19 axially spaced apart from the second sleeve 18 (see FIG. 2) and coupled with a shaft 10 of the window blind. The spool 12 has two projecting blocks 121 extending toward the second sleeve 18 and diametrically opposite to each other. The second axle 15 has a smaller-diameter axial segment 151 and a larger-diameter axial segment 152 coaxially opposite to each other for the first and second springs 161, 162 sleeved therearound, respectively. The second sleeve 18 has two projecting blocks 181 disposed at an end of the second sleeve 18, extending toward the spool 12 and diametrically opposite to each other, and a plurality of engaging protrusions 182 disposed at an opposite end of the second sleeve 18 to be coupled with the coupler 19. The second sleeve 18 further has two cam surfaces 183 extending from the projecting blocks 181, respectively, and each having a flat segment 184 and an inclined segment 185.

By pulling the cord 11 to rotate the spool 12, the projecting blocks 121 are moved along the cam surfaces 183 and abut against the projecting blocks 181, which in turn moves the second sleeve 18 axially to bring the engaging protrusions 182 into engagement with the coupler 19 so as to rotate the coupler 19 and the shaft 10 for rolling a curtain (not shown). At this stage, the second spring 162 is compressed to acquire a biasing force. Once the cord 11 is released, by means of biasing action of the second spring 162 and the coil spring 13, the second sleeve 18 is disengaged from the coupler 19 while the spool 12 is rotated in an opposite rotational direction to reel back the cord 11 and rotate the second sleeve 18 relative to the coupler 19 and the shaft 10. Subsequently, the operator pulls again the cord 11 to rotate the shaft 10 for rolling up the curtain.

Such the window blind may be moved upwardly in response to pulling down of a non-loop pulling rope for safety purposes. However, it is still desirable to improve a control device with a single non-loop pulling cord for rotating a shaft of a window blind to perform a stable and reliable operation.

SUMMARY

Therefore, an object of the disclosure is to provide a control device for a window blind that can alleviate at least one of the drawbacks of the prior art.

According to the disclosure, the control device is adapted for coupling with a shaft of a window blind extending in a front-and-rear direction and controlling rotation of the shaft in an unwinding direction and a winding direction, and includes a unidirectional drive unit, a rotation driving unit, a retaining unit, an output unit and a transmission unit.

The unidirectional drive unit includes a first ratchet seat and a second ratchet seat arranged axially and in the front-and-rear direction and rotatable with each other. The first ratchet seat defines a first surrounding groove which surrounds an axis of the shaft, and has a plurality of first teeth which border the first surrounding groove and which are angularly spaced apart from each other by a plurality of first notches that open toward the winding direction. The second ratchet seat defines a second surrounding groove which surrounds the axis of the shaft, and has a plurality of second teeth which border the second surrounding groove and which are angularly spaced apart from each other by a plurality of second notches that open toward the winding direction.

The rotation driving unit includes a spool assembly sleeved around the first ratchet seat and having a plurality of first guide slots each extending in the front-and-rear direction and facing radially the first surrounding groove, and a plurality of first rolling balls each slidably engaged in the first surrounding groove and one of the first guide slots. The spool assembly is operable to rotate in the unwinding direction to drive rotation of the first ratchet seat in the unwinding direction through the first rolling balls. The spool assembly is rotatable in the winding direction to drive movement of the first rolling balls in the first surrounding groove along the winding direction relative to the first ratchet seat so as not to rotate the first ratchet seat.

The retaining unit includes a tubular case immovably retained, sleeved around the second ratchet seat and having a plurality of second guide slots each extending in the front-and-rear direction and facing radially the second surrounding groove, and a plurality of second rolling balls each slidably engaged in the second surrounding groove and one of the second guide slots. The second ratchet seat is rotatable with the first ratchet seat in the unwinding direction to drive movement of the second rolling balls in the second surrounding groove along the unwinding direction relative to the second ratchet seat so as to restrict rotation of the second ratchet seat in the winding direction.

The output unit is disposed forwardly of the retaining unit, and is adapted to be coupled with and rotate the shaft.

The transmission unit is coupled with the output unit, and is operable to be shifted between a transmitting state where a torque generated as a result of the rotation of the unidirectional drive unit is transmitted to the output unit, and a non-transmitting state where the torque transmission is interrupted.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
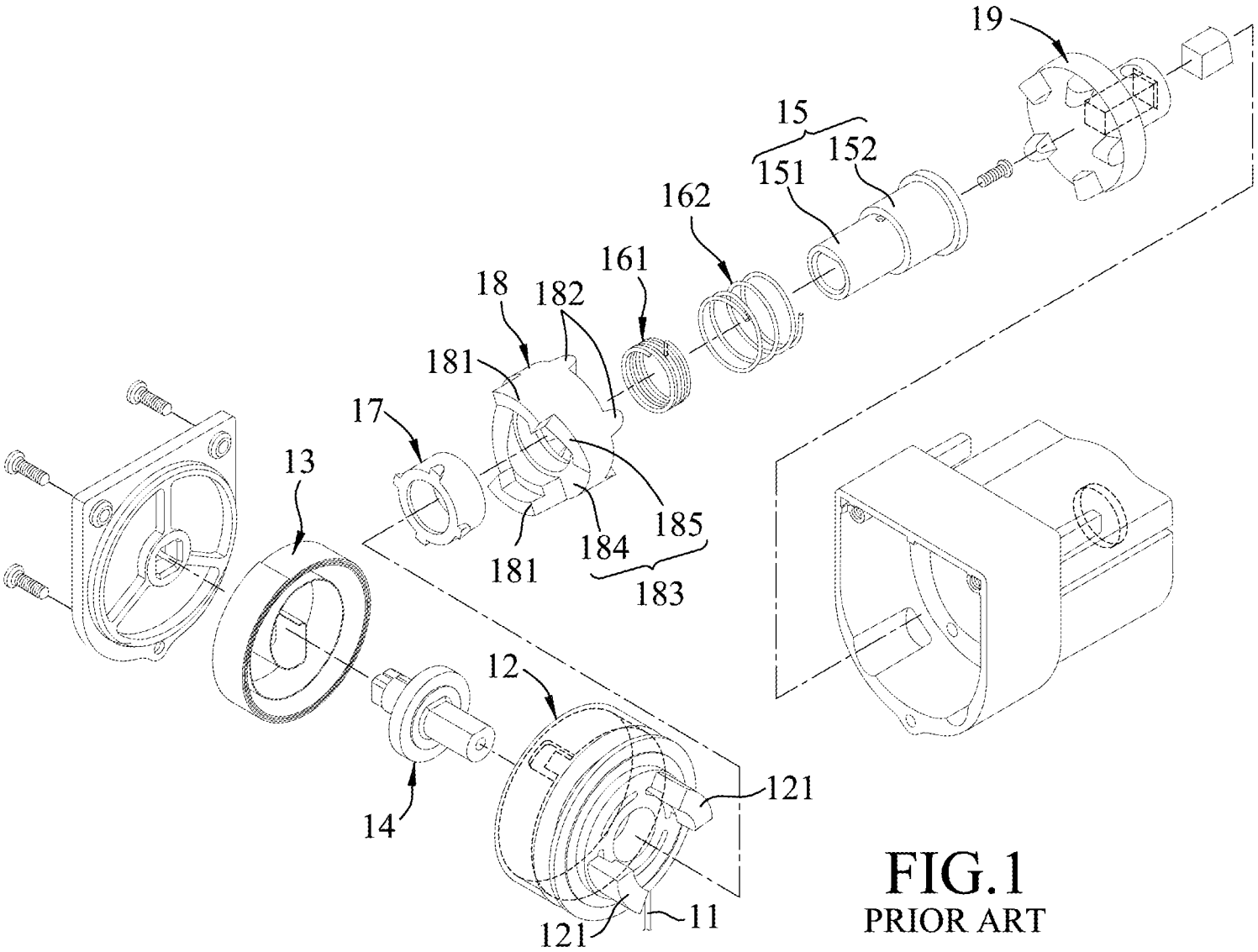
FIG.1 PRIOR ART
FIG. 1 is an exploded perspective view of a conventional control device for a window blind.
Figure 2:
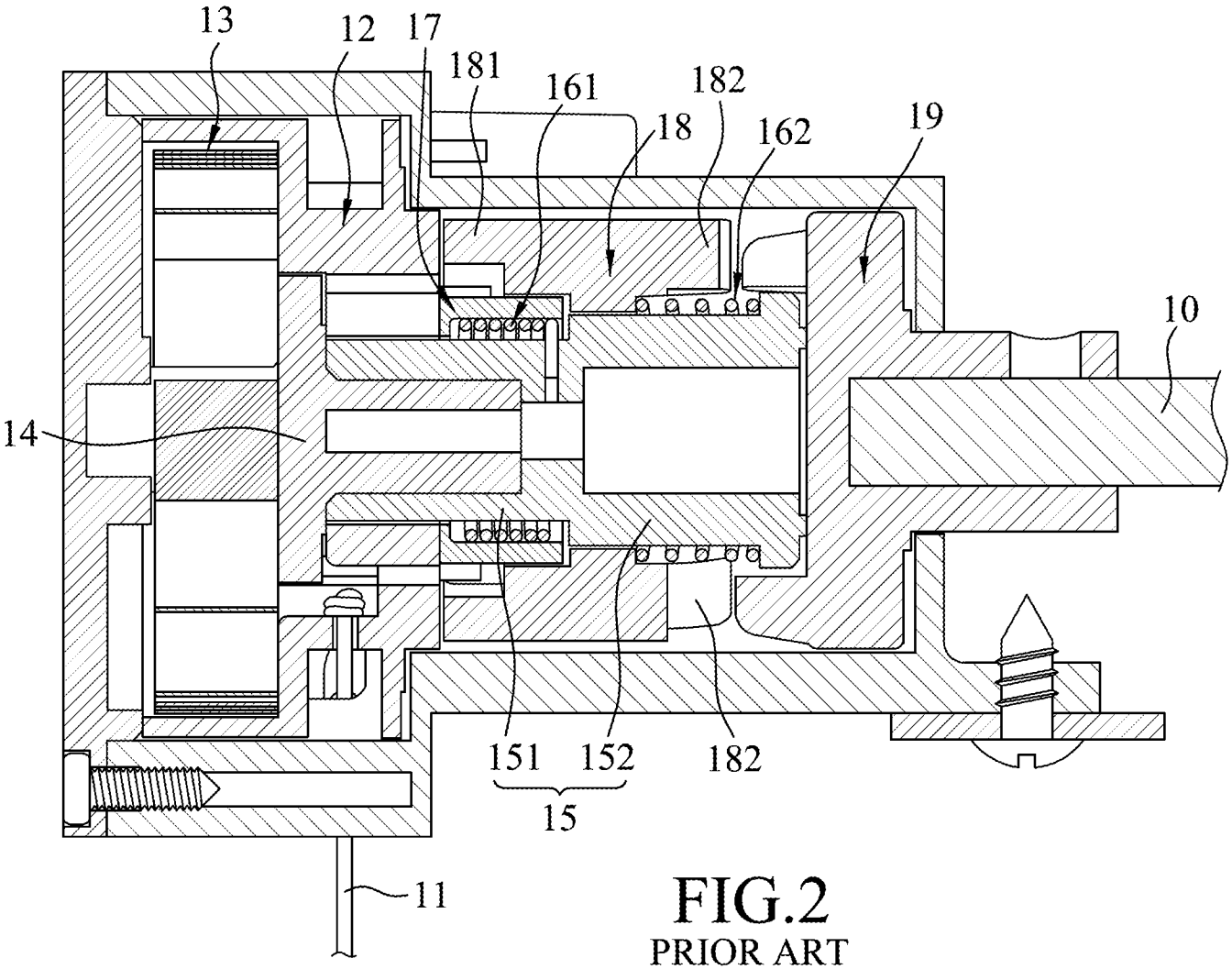
FIG.2 PRIOR ART
FIG. 2 is a fragmentary sectional view of the conventional control device in a transmitting state.
Figure 3:
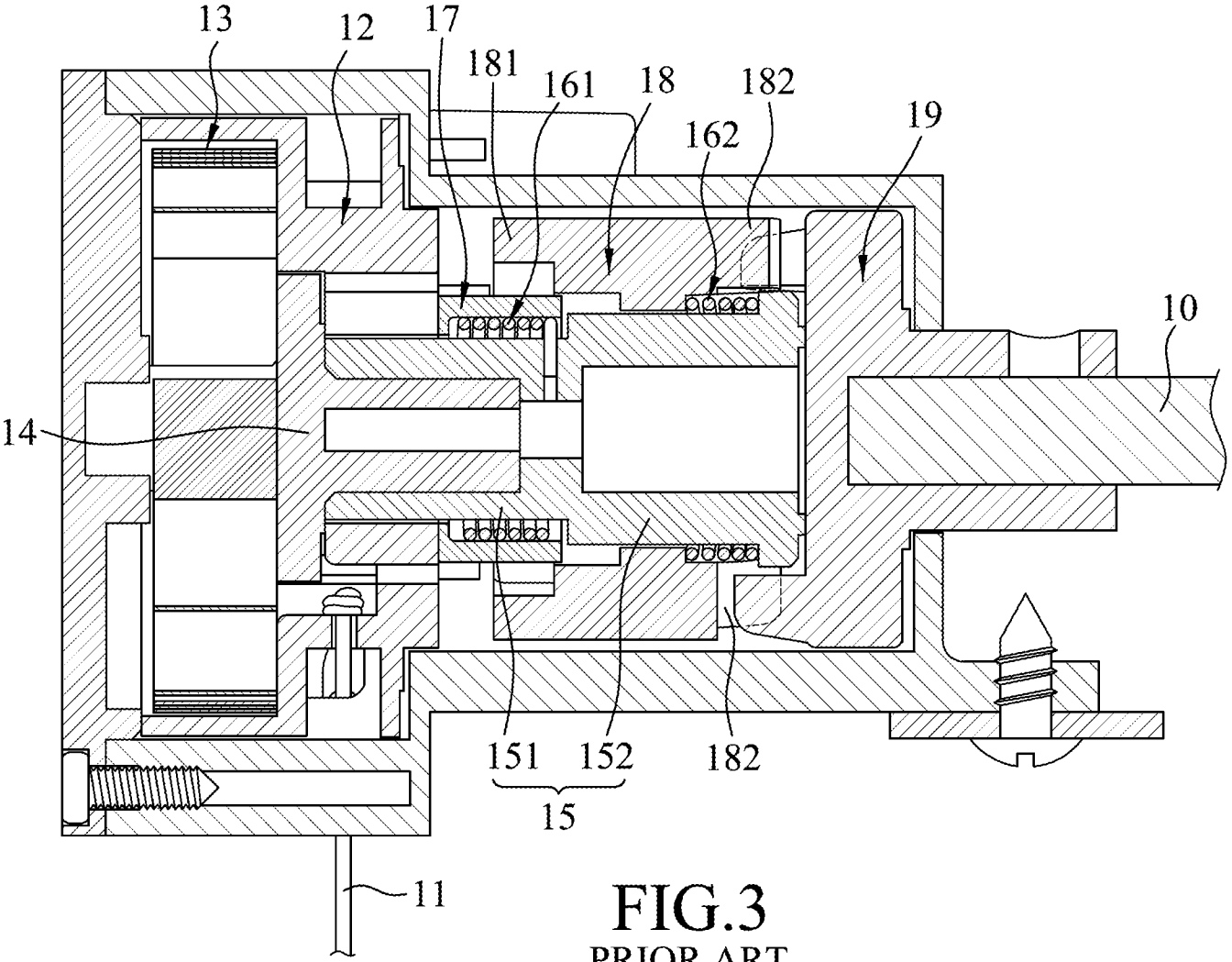
FIG.3 PRIOR ART
FIG. 3 is a fragmentary sectional view of the conventional control device in a non-transmitting state.
Figure 4:
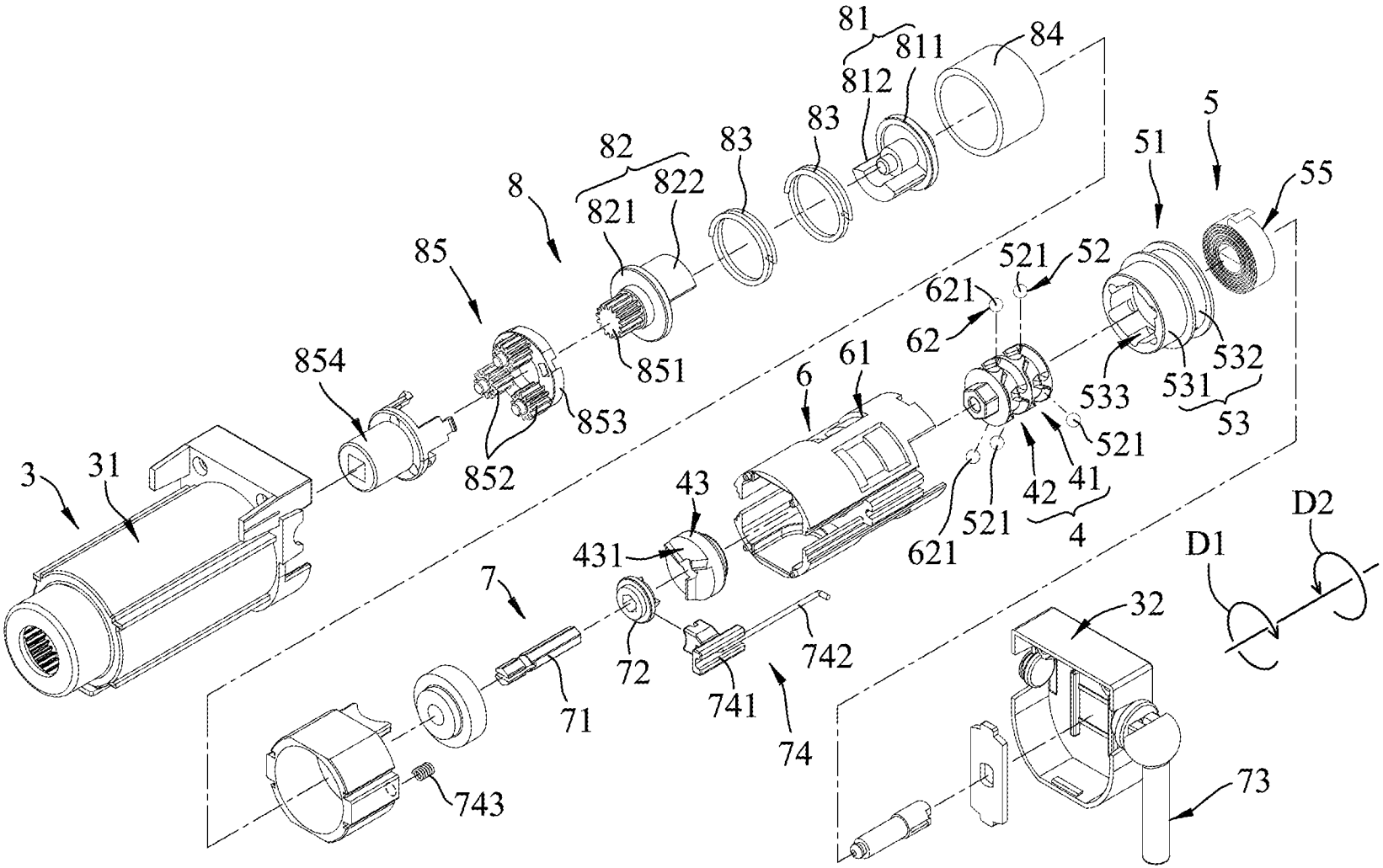
FIG. 4 is an exploded perspective view illustrating an embodiment of a control device for a window blind according to the disclosure.
Figure 5:
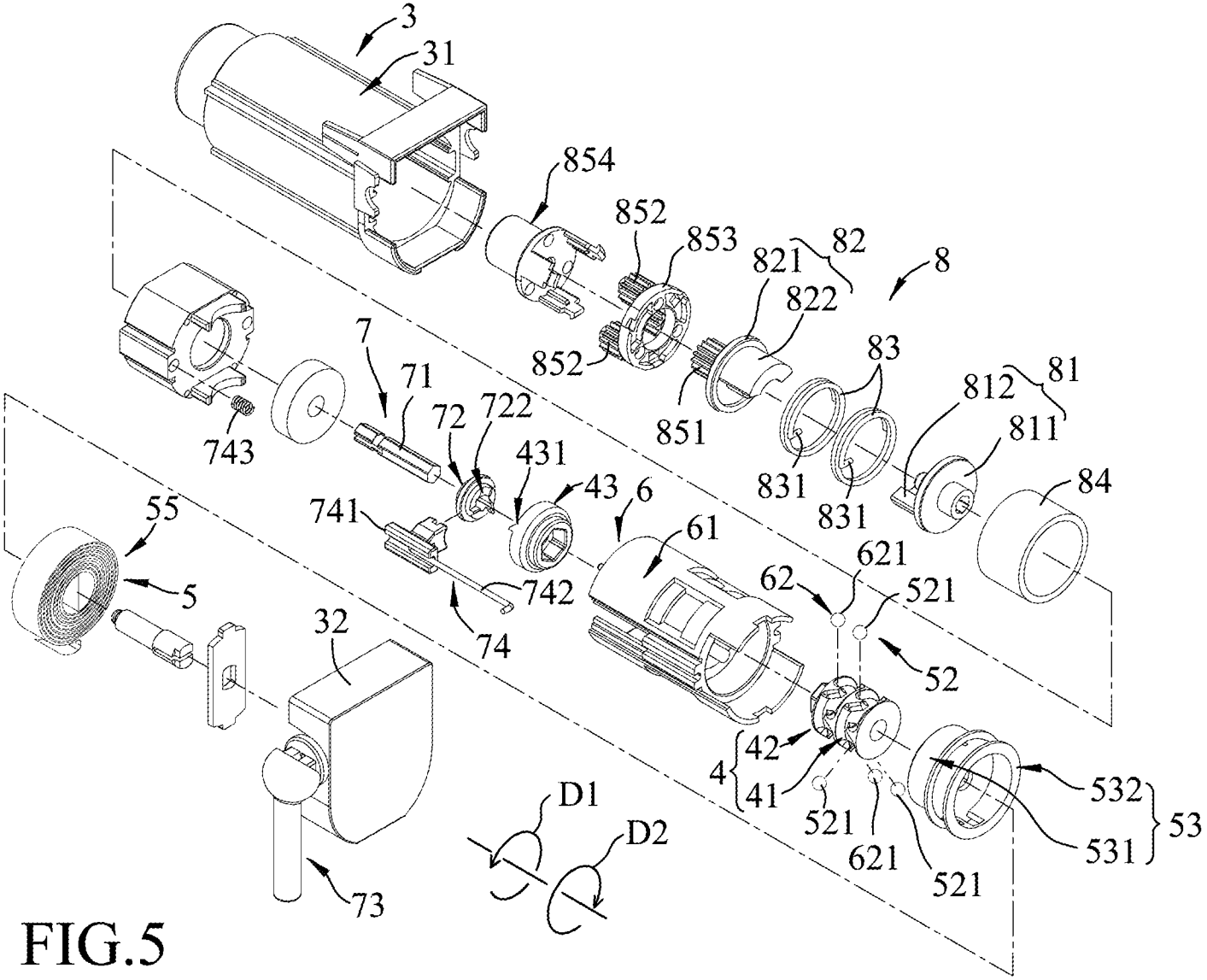
FIG. 5 is an exploded perspective view of the embodiment taken from another angle.
Figure 6:
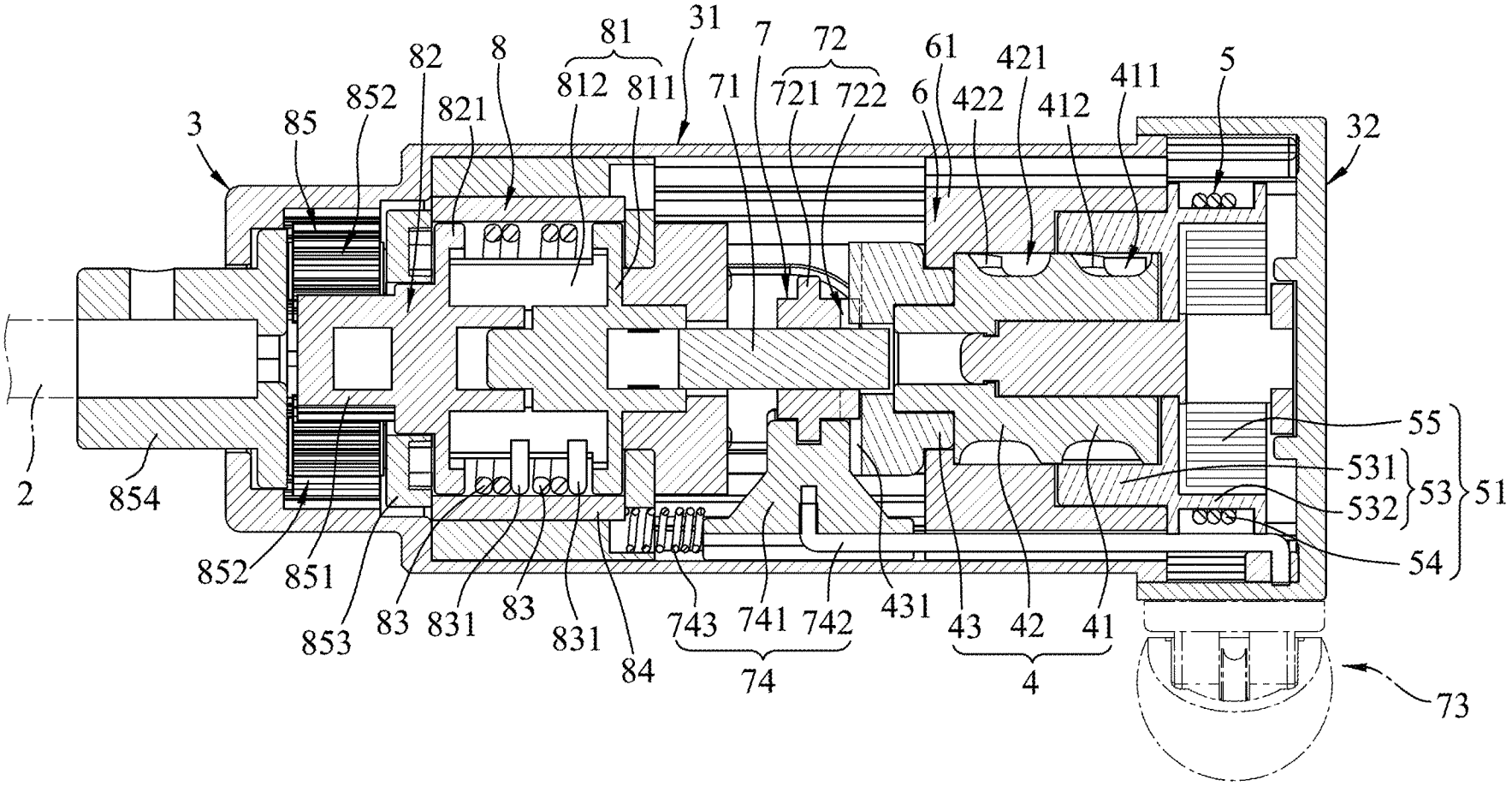
FIG. 6 is a sectional view of the embodiment illustrating a transmitting state of a transmission unit.
Figure 7:
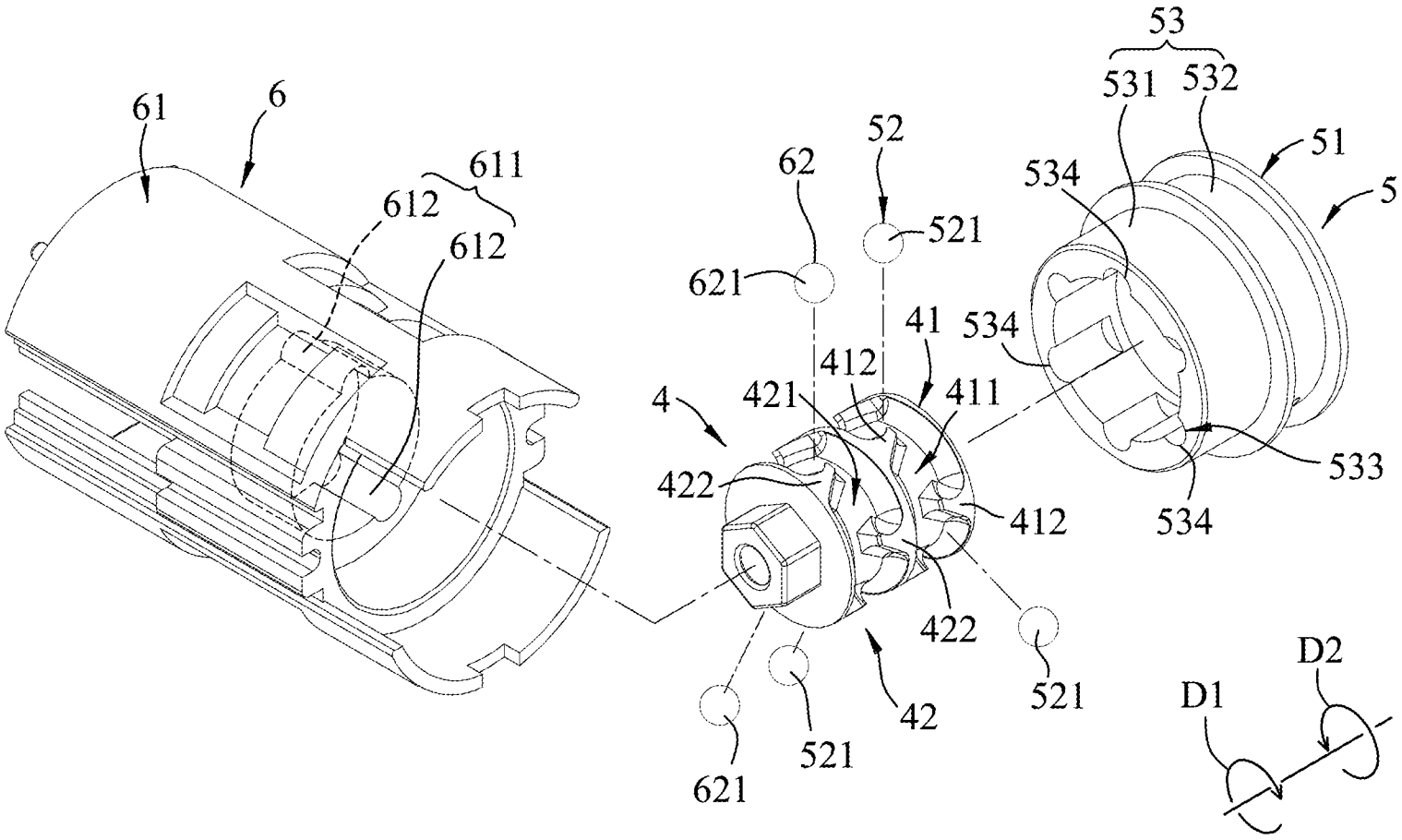
FIG. 7 is an exploded perspective view illustrating a unidirectional drive unit, a rotation driving unit and a retaining unit of the embodiment.
Figure 8:
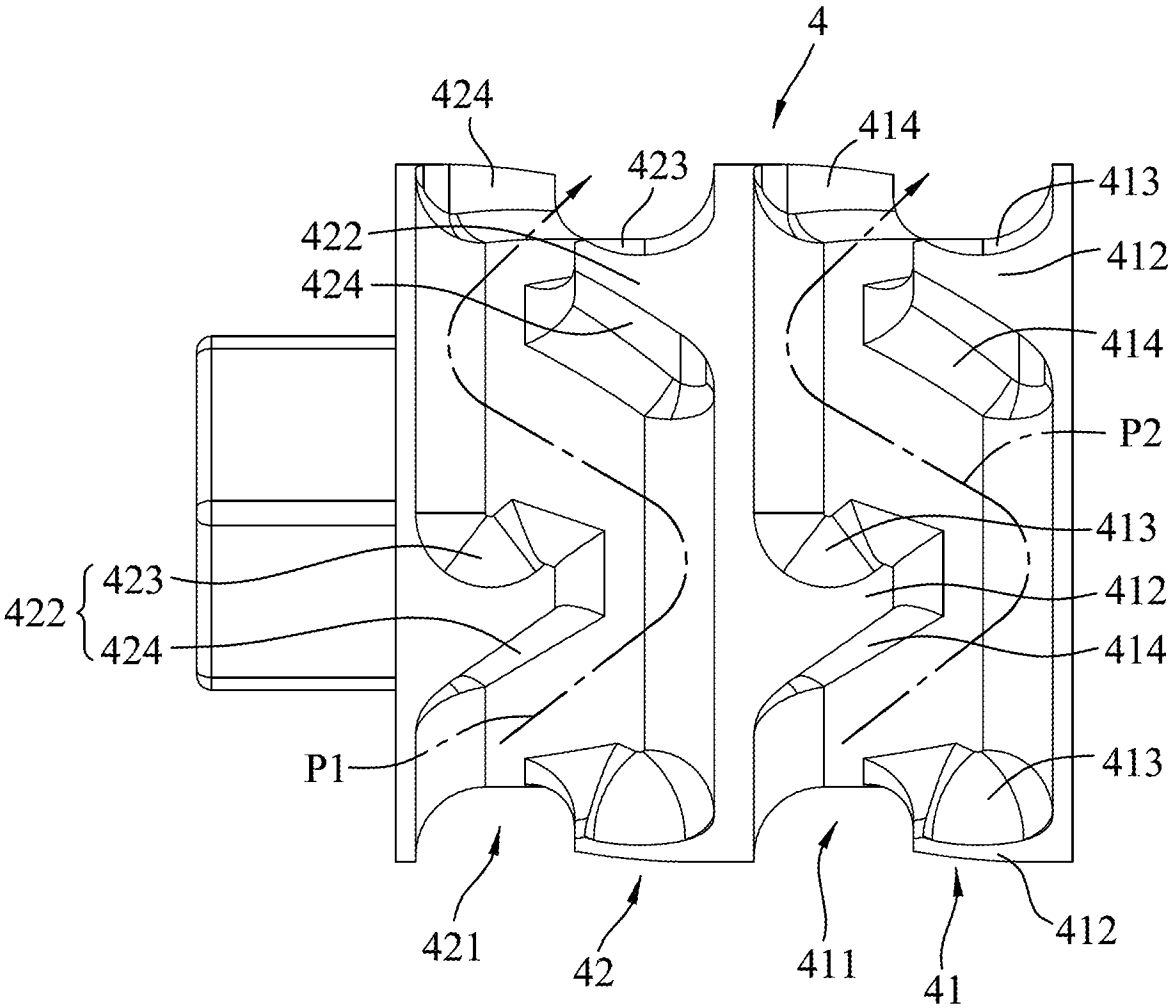
FIG. 8 is a fragmentary top view illustrating first and second ratchet seats of the unidirectional drive unit.

Referring to FIGS. 4, 5 and 6, an embodiment of a control device for a window blind is adapted for coupling with a shaft 2 (see FIG. 6) of the window blind and for controlling rotation of the shaft 2 in an unwinding direction (D1) and a winding direction (D2). The shaft 2 extends in a front-and-rear direction. The control device of the embodiment includes a housing unit 3, a unidirectional drive unit 4 disposed inside the housing unit 3, a rotation driving unit 5 sleeved around the unidirectional drive unit 4 and disposed rearwardly thereof, a retaining unit 6 sleeved around the unidirectional drive unit 4 and disposed forwardly thereof, a transmission unit 7 coupled to the unidirectional drive unit 4, and an output unit 8 disposed forwardly of and coupled with the transmission unit 7.

The housing unit 3 includes a cylindrical housing 31 and a rear cover 32 disposed to cover a rear end of the housing 31.

With reference to FIGS. 4, 7, 8 and 9, the unidirectional drive unit 4 includes a first ratchet seat 41 and a second ratchet seat 42 arranged axially and in the front-and-rear direction and rotatable with each other, and a transmitting seat 43 coaxially coupled to and rotatable with a front end of the second ratchet seat 42. In this embodiment, the first and second ratchet seats 41, 42 are integrally formed with each other.

The first ratchet seat 41 is of a ring shape, and defines, in its outer surrounding surface, a first surrounding groove 411 which surrounds an axis of the shaft 2. The first ratchet seat 41 has a plurality of first teeth 412 which border the first surrounding groove 411 and which are angularly spaced apart from each other by a plurality of first notches that open toward the winding direction (D2). Each of the first teeth 412 has a first abutment edge face 413 facing the winding direction (D2) and concaved toward the unwinding direction (D1), and a first guiding edge face 414 facing the unwinding direction (D1) and inclined along the winding direction (D2) and toward an adjacent one of the first teeth 412. In this embodiment, a first part of the first teeth 412 each extend forwardly from a rear side of the first ratchet seat 41, and a second part of the first teeth 412 each extend rearwardly from a front side of the first ratchet seat 41. Each of the first teeth 412 of the first part is interposed between two adjacent ones of the first teeth 412 of the second part, and each of the first teeth 412 of the second part is also interposed between two adjacent ones of the first teeth 412 of the first part, so as to form a first curve path (P2) in the first surrounding groove 411.

The second ratchet seat 42 is of a ring shape, is integrally connected with a front end of the first ratchet seat 41, and defines, in its outer surrounding surface, a second surrounding groove 421 which surrounds the axis of the shaft 2. The second ratchet seat 42 has a plurality of second teeth 422 which border the second surrounding groove 421 and which are angularly spaced apart from each other by a plurality of second notches that open toward the winding direction (D2). Each of the second teeth 422 has a second abutment edge face 423 facing the winding direction (D2) and concaved toward the unwinding direction (D1), and a second guiding edge face 424 facing the unwinding direction (D1) and inclined along the winding direction (D2) and toward an adjacent one of the second teeth 422. In this embodiment, a first part of the second teeth 422 each extend forwardly from a rear side of the second ratchet seat 42, and a second part of the second teeth 422 each extend rearwardly from a front side of the second ratchet seat 42. Each of the second teeth 422 of the first part is interposed between two adjacent ones of the second teeth 422 of the second part, and each of the second teeth 422 of the second part is interposed between two adjacent ones of the second teeth 422 of the first part, so as to form a second curve path (P1) in the second surrounding groove 421.

The transmitting seat 43 has a tubular rear end sleeved on and in a spline engagement with the front end of the second ratchet seat 42 so as to be rotated with the second ratchet seat 42. A front end of the transmitting seat 43 is of a disc shape, and has a mating toothed structure 431 projecting forwardly toward the transmission unit 7.

Referring to FIGS. 4, 6, 7 and 9, the rotation driving unit 5 includes a spool assembly 51 sleeved around the first ratchet seat 41, and a first ball assembly 52 engaged within the spool assembly 51.

The spool assembly 51 includes a spool tube 53 sleeved around the first ratchet seat 41, a pulling cord 54 (see FIG. 6) coupled to and wound around the spool tube 53 such that the spool tube 53 is rotated in the unwinding direction (D1) when the pulling cord 54 is operated to be unwound from the spool tube 53, and a biasing member 55 disposed within the spool tube 53 to acquire a biasing force for rotation of the spool tube 53 in the winding direction (D2) when the pulling cord 54 is unwound.

The spool tube 53 includes a front tube portion 531 and a rear tube portion 532 integrally formed with each other. An inner tubular surface of the front tube portion 531 is formed with a first guide slot assembly 533 having a plurality of first guide slots 534 each extending in the front-and-rear direction and facing radially the first surrounding groove 411. Each first guide slot 534 has a semi-circular cross-section. The pulling cord 54 is wound around the rear tube portion 532 and has an operated end extending outwardly of the housing unit 3 to be operated to rotate the spool tube 53 in the unwinding direction (D1). The biasing member 55 is a coil spring to acquire the biasing force when the pulling cord 54 is pulled. The first ball assembly 52 includes a plurality of first rolling balls 521 each slidably engaged in the first surrounding groove 411 and one of the first guide slots 534.

The retaining unit 6 includes a tubular case 61 immovably retained within the housing 31 and sleeved around the second ratchet seat 42, and a second ball assembly 62 rollably engaged in the tubular case 61 and the second ratchet seat 42.

With reference to FIGS. 4, 6, 7 and 10, the tubular case 61 is of a ring shape. An inner tubular surface of the tubular case 61 is formed with a second guide slot assembly 611 having a plurality of second guide slots 612 each extending in the front-and-rear direction and facing radially the second surrounding groove 421. Each second guide slot 612 has a semi-circular cross-section. The second ball assembly 62 includes a plurality of second rolling balls 621 each slidably engaged in the second surrounding groove 421 and one of the second guide slots 612.

Referring to FIGS. 4, 5 and 6, the transmission unit 7 includes a transmission axle 71 extending along the axis, coupled with the output unit 8 and inserted into the transmitting seat 43, a coupling sleeve 72 sleeved and non-rotatable retained on the transmission axle 71 to permit the transmission axle 72 to rotate therewith, a control member 73 spaced apart from the coupling sleeve 72 and disposed on the rear cover 32, and a control assembly 74 coupled with the coupling sleeve 72 and the control member 73.

The transmission axle 71 is loosely inserted into the transmitting seat 43 to be freely rotatable, and is movable axially in the front-and-rear direction relative to the transmitting seat 43. The coupling sleeve 72 is of a ring shape, and has a tubular flange 721 extending radially and outwardly, and a mating toothed structure 722 projecting rearwardly from a rear end thereof toward the transmitting seat 43. The mating toothed structure 722 is in mesh with the mating toothed structure 431 of the transmitting seat 43 so as to permit the coupling sleeve 72 and the transmission axle 71 to rotate with the transmitting seat 43. The control member 73 is in the form of a control lever pivoted to the rear cover 32 and for the pulling cord 54 to pass through, and is operable by an operator. The control assembly 74 includes a coupling mount 741 retained to the tubular flange 721 to permit the coupling sleeve 72 to move therewith, a thrust member 742 connected between the control member 73 and the coupling mount 741, and a biasing member 743 abutting against the coupling mount 741. The thrust member 742 is in the form of a lever and has two ends respectively connected to the control member 73 and the coupling mount 741. The biasing member 743 is in the form of a compression spring abutting against the coupling mount 741.

Figure 11:
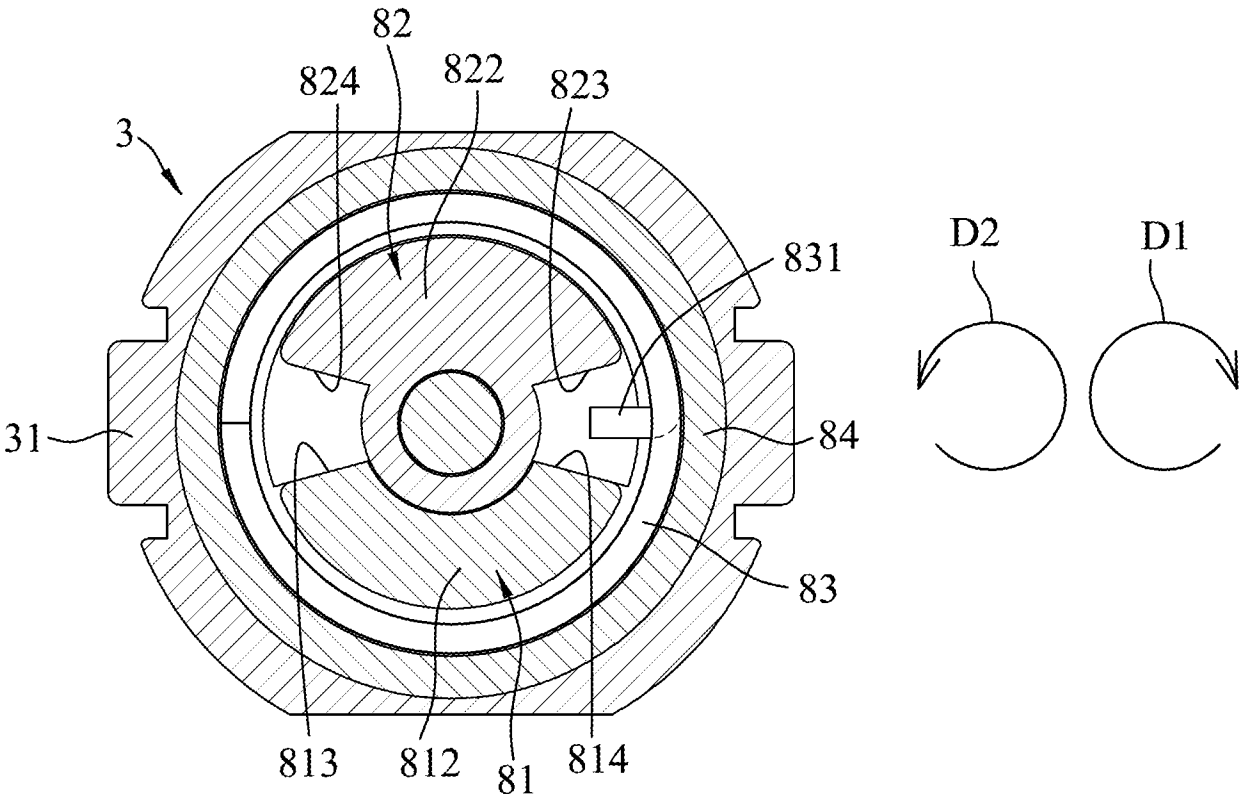
FIG. 11 is a cross-sectional view illustrating a structure of an output unit of the embodiment.

Referring to FIGS. 4, 6 and 11, the output unit 8 includes a first actuating seat 81 coupled to be driven by the transmission axle 71 to rotate coaxially, a second actuating seat 82 disposed forwardly of the first actuating seat 81, two torsion springs 83 sleeved around the first and second actuating seats 81, 82, a sleeve member 84 sleeved around the torsion springs 83 and having an inner sleeve surface for the torsion springs 83 to abut thereagainst, and a gear speed reducer 85 disposed forwardly of the second actuating seat 82.

Each of the first and second actuating seats 81, 82 has a disc portion 811, 821 and a curved portion 812, 822 extending from the disc portion 811, 821 axially in the front-and-rear direction and extending about the axis. The disc portions 811, 821 are spaced apart from each other axially. The curved portion 812 of the first actuating seat 81 has a first unwinding edge 813 facing the unwinding direction (D1), and a first winding edge 814 facing the winding direction (D2) and angularly opposite to the first unwinding edge 813. The curved portion 822 of the second actuating seat 82 has a second unwinding edge 823 facing the unwinding direction (D1) and the first winding edge 814, and a second winding edge 824 facing the winding direction (D2) and the first unwinding edge 813 and angularly opposite to the second unwinding edge 823. Each of the torsion springs 83 is sleeved around the curved portions 812, 822, is compressedly disposed inside the sleeve member 84, and has a spring end 831 disposed between the first winding edge 814 and the second unwinding edge 823. The gear speed reducer 85 includes a sun gear 851 integrally disposed on a front end of the second actuating seat 82, a plurality of planet gears 852 angularly displaced from each other about the axis and meshing with the sun gear 851, a carrier web 853 for the planet gears 852 to be disposed thereon, and an output sleeve 854 coupled to rotate with the carrier web 853 and adapted to be coupled with and rotate the shaft 2.

Figure 12:
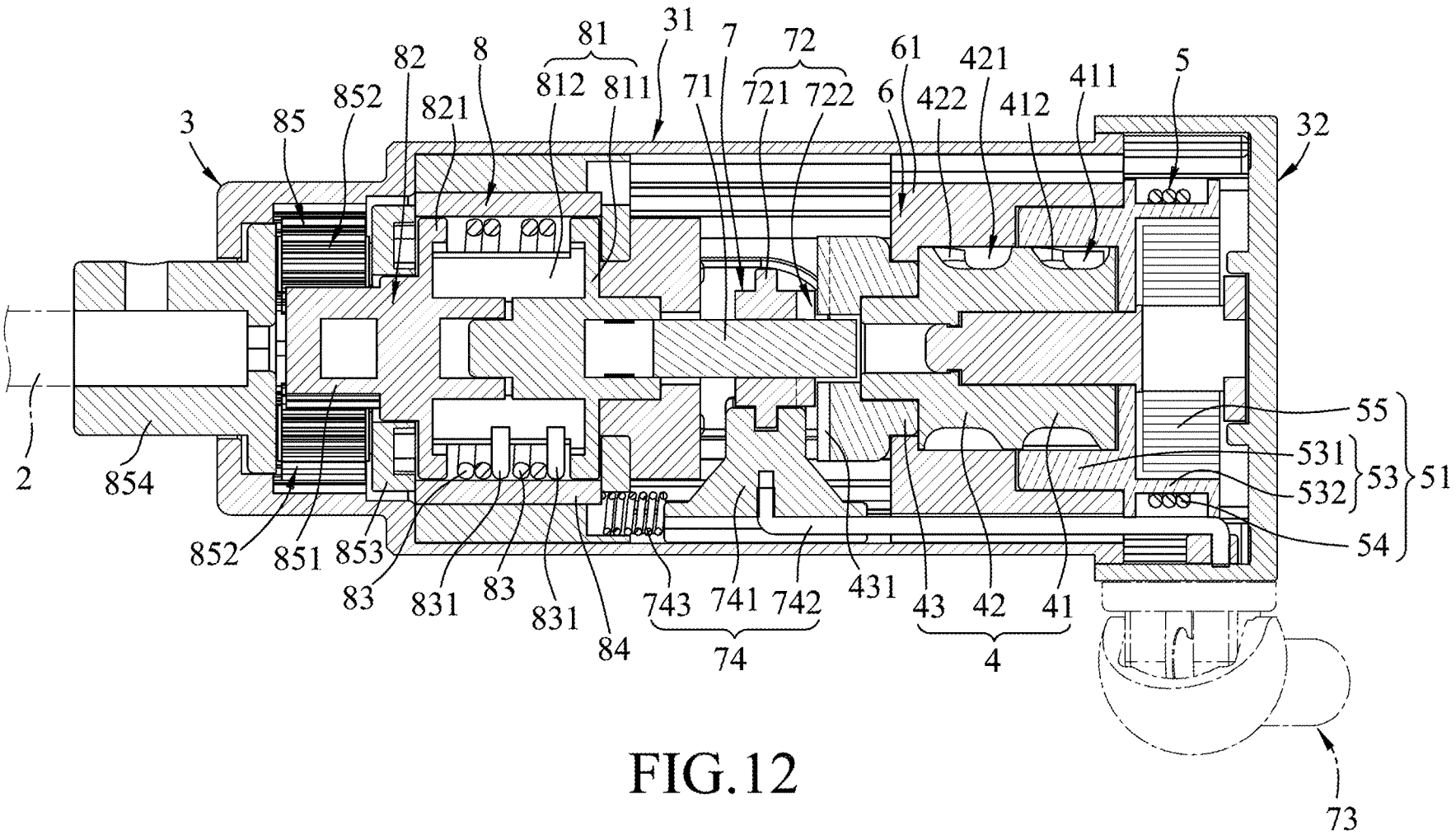
FIG. 12 is a sectional view similar to FIG. 6, illustrating a non-transmitting state of the transmission unit.

Referring to FIGS. 4, 6 and 12, the transmission unit 7 is operable to be shifted between a transmitting state (see FIG. 6) where a torque generated as a result of the rotation of the unidirectional drive unit 4 is transmitted to the output unit 8, and a non-transmitting state (see FIG. 12) where the torque transmission is interrupted.

Specifically, in the transmitting state, the control member 73 extends uprightly, and the coupling sleeve 72 is in a coupling position, where the mating toothed structure 722 is in mesh with the mating toothed structure 431 of the transmitting seat 43 so as to be driven by and rotated with the transmitting seat 43 and to rotate the transmission axle 71 to thereby rotate the first actuating seat 81.

By operating the control member 73 to turn the same rearwardly, the coupling sleeve 72 is driven through the thrust member 742 and the coupling mount 741 to move axially and forwardly to a disengaged position, where the coupling sleeve 72 is disengaged from the transmitting seat 43 to bring the transmitting unit 7 in the non-transmitting state. At this stage, the biasing member 743 is compressed to bias the coupling mount 741 rearwardly to bring the coupling sleeve 72 to the coupling position.

In the non-transmitting state, the control member 73 is inclined rearwardly, and the coupling sleeve 72 is spaced apart from the transmitting seat 43 axially so as to interrupt the torque transmission from the transmitting seat 43 to the transmission unit 7 and hence to the output unit 8.

Figure 9:
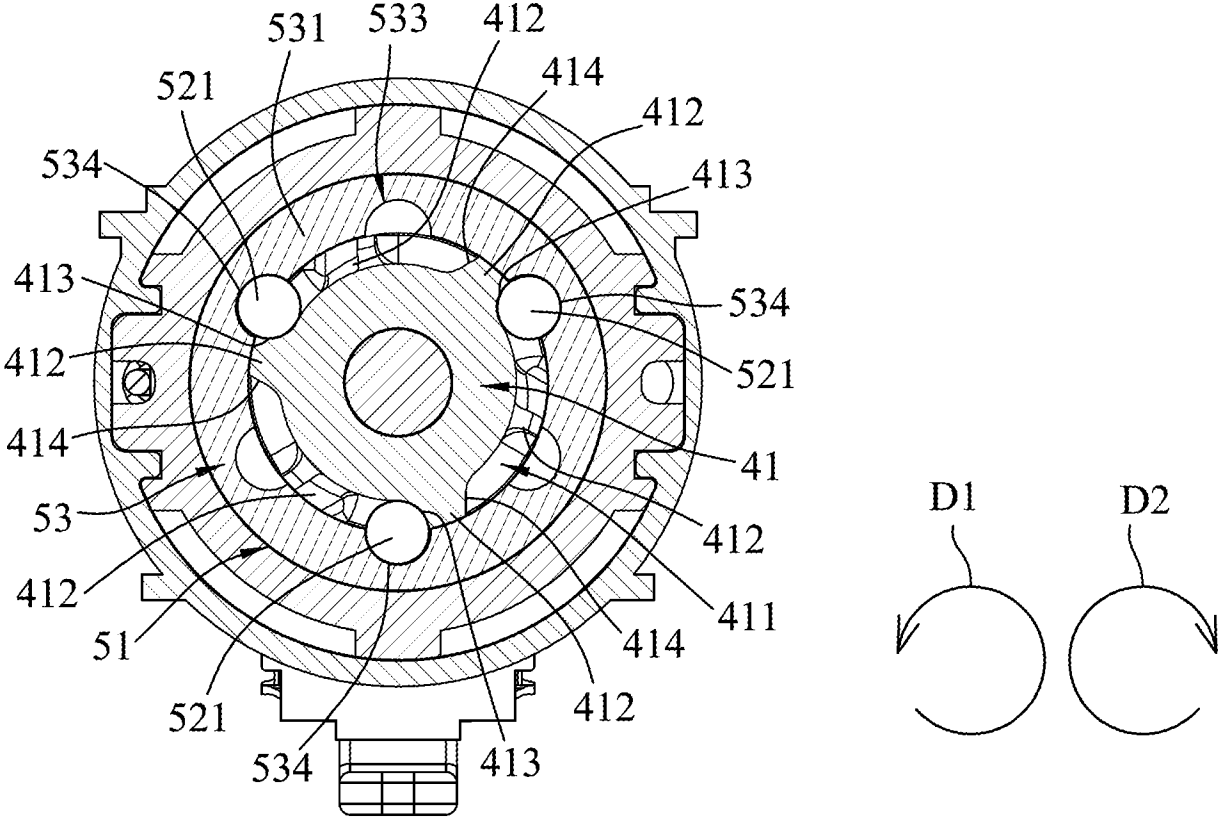
FIG. 9 is a cross-sectional view illustrating the first ratchet seat and the rotation driving unit.
Figure 10:
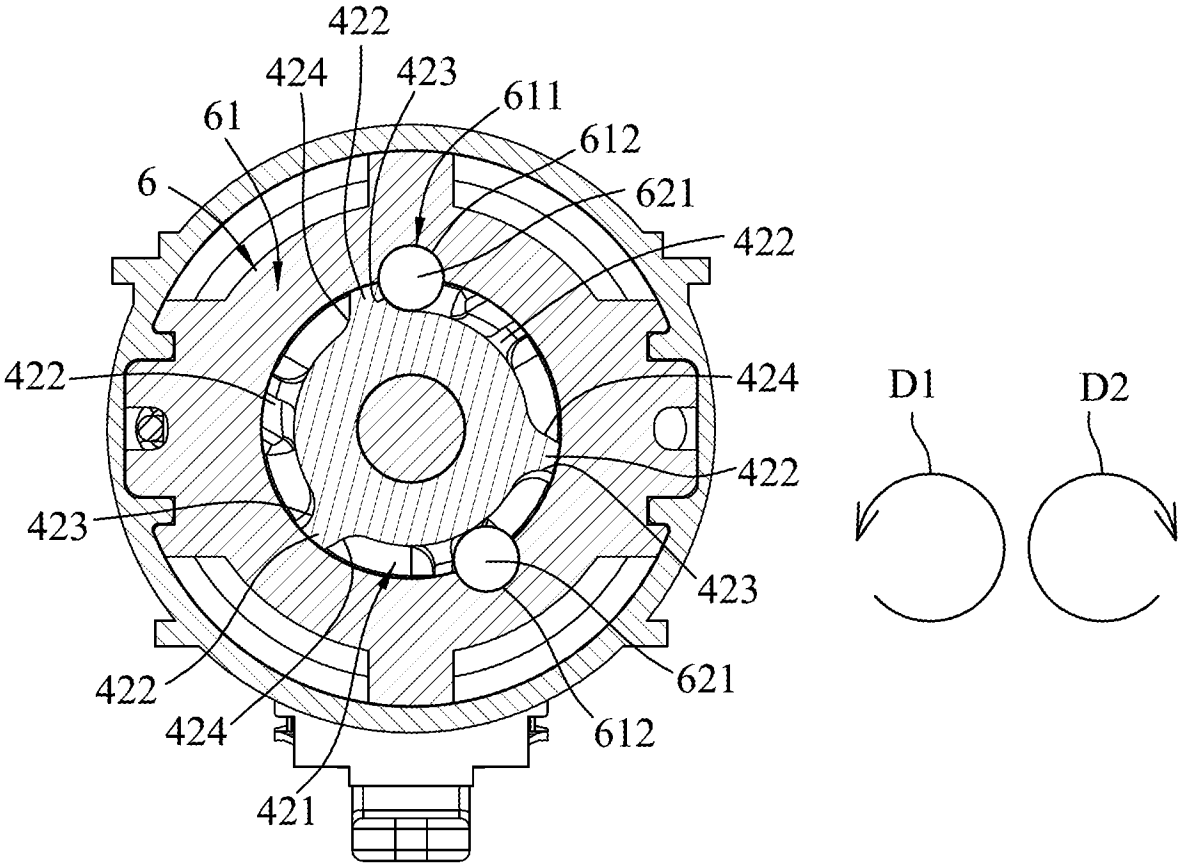
FIG. 10 is a cross-sectional view illustrating the second ratchet seat and the retaining unit.

Referring to FIGS. 4, 6 and 9, when the transmission unit 7 is in the transmitting state, the pulling cord 54 is pulled out through the control member 73 to rotate the spool tube 53 in the unwinding direction (D1), and each of the first rolling balls 521 is moved in the first surrounding groove 411 and abuts against and is engaged with the first abutment edge face 413 of the corresponding first tooth 412 so as to rotate the first ratchet seat 41 with the spool tube 53 in the unwinding direction (D1).

Referring to FIGS. 4, 6, 8 and 10, at this time, the second ratchet seat 42 integrally formed with the first ratchet seat 41 is rotated in the unwinding direction (D1), and, due to the immovably retained tubular case 61, the second rolling balls 621 are moved in the front-and-rear direction through guiding by the second guiding edge faces 424 of the second teeth 422, and in the second guide slots 612 along the second surrounding groove 421 (along the second curved path (P1)) relative to the second ratchet seat 42 so as to permit the rotation of the second ratchet seat 42 relative to the tubular case 61 in the unwinding direction (D1).

Meanwhile, the transmitting seat 43 is coaxially rotated with the second ratchet seat 42, and the coupling sleeve 72, the transmission axle 71 and the first actuating seat 81 are rotated in the unwinding direction (D1).

Figure 13:
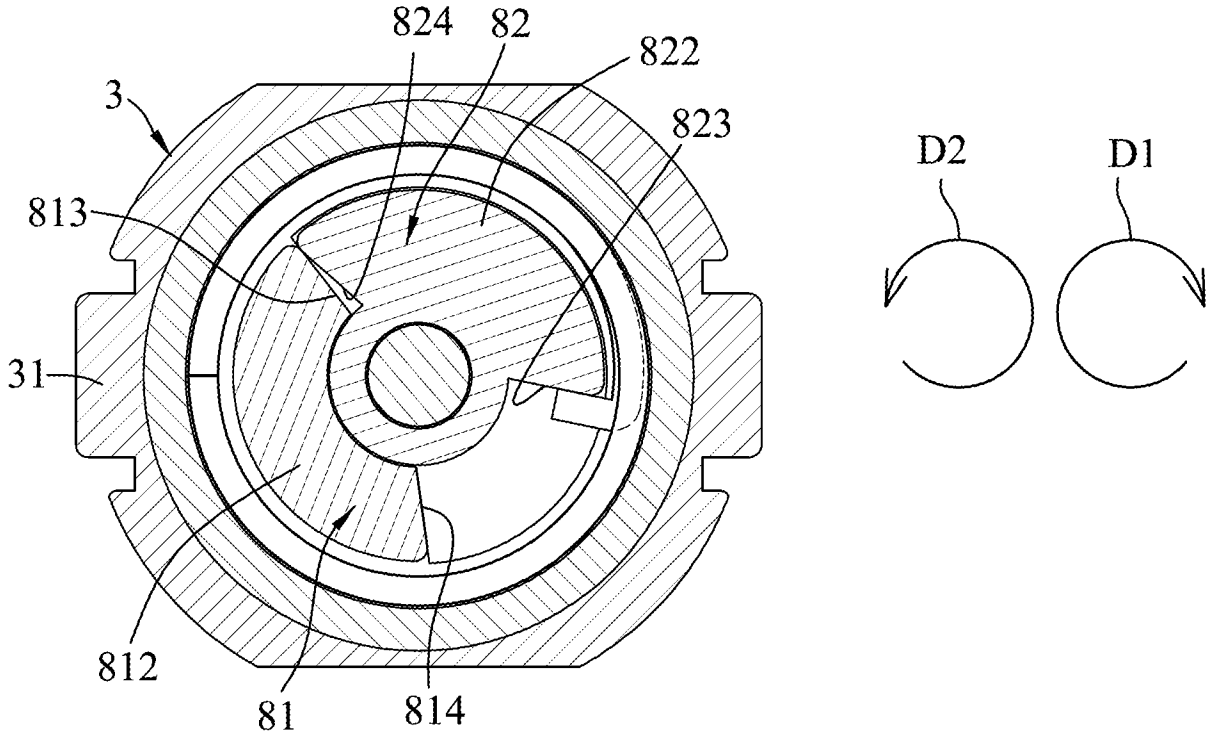
FIG. 13 is a cross-sectional view similar to FIG. 11, illustrating a state when a first actuating seat of the output unit is rotated in an unwinding direction.
Figure 14:
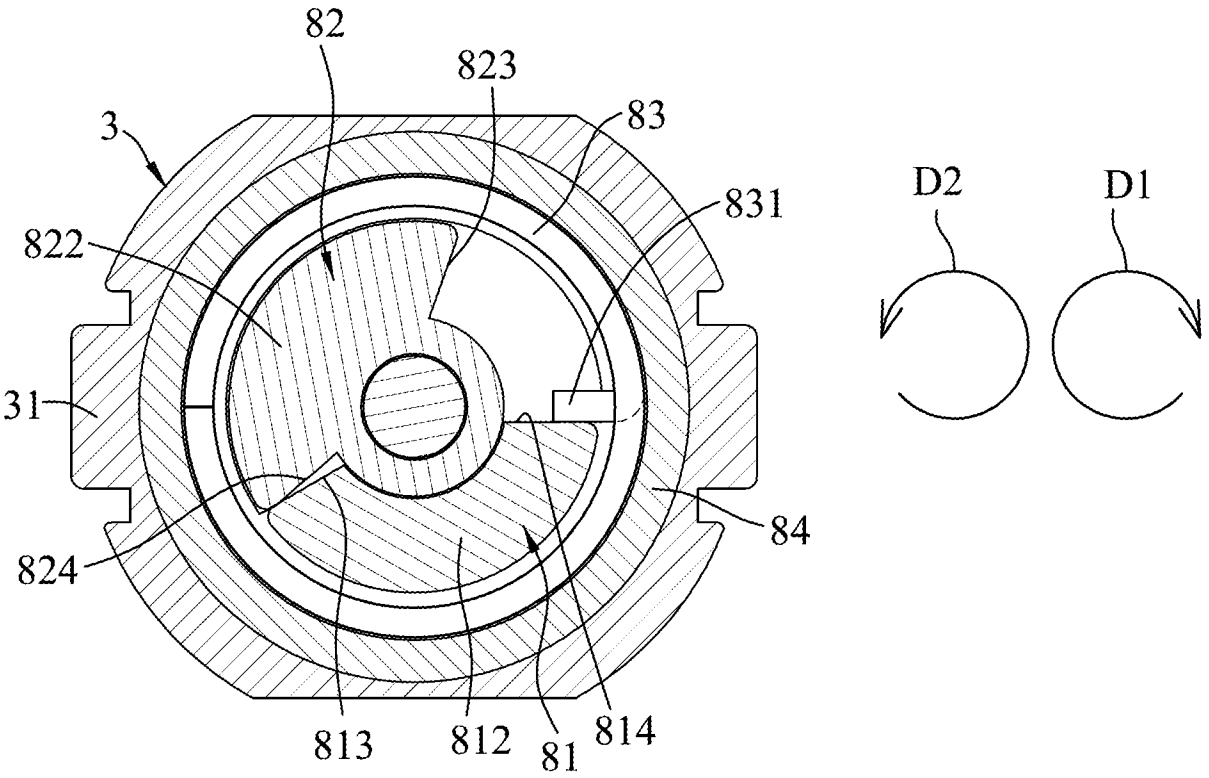
FIG. 14 is a cross-sectional view similar to FIG. 11, illustrating a state when a second actuating seat of the output unit is rotated in a winding direction.

Referring to FIGS. 4, 6 and 13, during rotation of the first actuating seat 81, the first unwinding edge 813 of the first actuating seat 81 abuts against the second winding edge 824 of the second actuating seat 82 to rotate the second actuating seat 82 in the unwinding direction (D1), and the second unwinding edge 823 abuts against the spring ends 831 of the torsion springs 83 to pull the torsion springs 83 so as to narrow the diameter of the torsion springs 83, which facilitates rotation of the torsion springs 83 relative to the sleeve member 84.

During the rotation of the second actuating seat 82 in the unwinding direction (D1), the sun gear 851 is rotated in the unwinding direction (D1) and drives rotation of the planet gears 852, the carrier web 853 and the output sleeve 854 in the winding direction (D2), which results in rotation of the shaft 2 in the winding direction (D2) so as to roll up a curtain.

Referring to FIGS. 4, 6, 8 and 9, when the operator releases the pulling cord 54, the spool tube 53 is rotated in the winding direction (D2) by the biasing force of the biasing member 55, and the first rolling balls 521 are guided by the first guiding edge faces 414 of the first ratchet seat 41 to roll in and along the first surrounding groove 411 and along the first winding direction (D2) (i.e. along the first curve path (P2)) relative to the first ratchet seat 41 so as to prevent the first ratchet seat 41 from rotation with the spool assembly 51 in the winding direction (D2).

Specifically, when the operator releases the pulling cord 54, the spool tube 53 is rotated to wind back the pulling cord 54 whilst the first ratchet seat 41 is not rotated therewith. The operator may repeat the pulling and releasing of the pulling cord 54 to wind up the window blind to a desired position.

Referring to FIGS. 4, 6, 8 and 10, once the operator releases the pulling cord 54, the transmitting seat 43 and the second ratchet seat 42, with weight of the curtain, might tend to be rotated in the winding direction (D2) through the output unit 8 and the transmission unit 7. Nevertheless, in this embodiment of the control device, with the second notches defined by the second teeth 422 being disposed to open toward the winding direction (D2), each of the second rolling balls 621 is abuttingly engaged with the second abutment edge face 423 so as not to be moved along the second surrounding groove 421 (only to be moved in the front-and-rear direction in the second guide slot 612), which restricts the rotation of the second ratchet seat 42 in the winding direction (D2). Thus, when the operator releases the pulling cord 54 to permit winding back of the pulling cord 54, the curtain is retained by the retaining unit 6 to its current position and to prevent from a large, undesired downward spread of the curtain.

Referring to FIGS. 4, 6, 12 and 14, when the control member 73 is operated to shift the transmission unit 7 to the non-transmitting state, the coupling sleeve 72 is in the disengaged position to be disengaged from the transmitting seat 43, and, with the tubular case 61 that restricts the second ratchet seat 42 and the transmitting seat 43, the transmission unit 7 and the output unit 8 are allowed to be rotated by the shaft 2. At this stage, the curtain is lowered and spread by means of its weight and rotates the output unit 8 and the transmission unit 7. Specifically, when the operator turns the control member 73 to shift the transmission unit 7 to the non-transmitting state, the curtain will be lowered and spread out freely. Once the operator releases the control member 73, the transmission unit 7 is returned back to the transmitting state by means of the biasing member 743.

In particular, when the second actuating seat 82 is rotated in the winding direction (D2) due to lowering of the curtain, the second winding edge 824 abuts against the first unwinding edge 813 to rotate the first actuating seat 81 in the winding direction (D2). During the rotation of the first actuating seat 81, the first winding edge 814 abuts against the spring ends 831 of the torsion springs 83 to press the torsion springs 83 so as to increase the diameter of the torsion springs 83 for increasing frictional contact of the torsion springs 83 with the sleeve member 84 and providing a resistance to retard the lowering speed of the curtain for safety purposes. It should be noted that the number of the torsion springs 83 may be varied to be one or more than two torsion springs.

As illustrated, the control device has a novel construction with a single non-loop pulling cord for rotating a shaft of a window blind to perform a stable and reliable operation. Moreover, with the output unit 8 having the first and second actuating seats 81, 82, the torsion springs 83 and the sleeve member 84, lowering of the curtain is alleviated for rendering the operation stable and safe.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A control device for coupling with a shaft of a window blind extending in a left-to-right direction, and for controlling rotation of the shaft in an unwinding direction and a winding direction, said control device comprising:

a unidirectional drive unit including a first ratchet seat and a second ratchet seat arranged axially and in the left-to-right direction and rotatable with each other, said first ratchet seat defining a first surrounding groove which surrounds an axis of the shaft, and having a plurality of first teeth which border said first surrounding groove and which are angularly spaced apart from each other by a plurality of first notches that open toward the winding direction, said second ratchet seat defining a second surrounding groove which surrounds the axis of the shaft, and having a plurality of second teeth which border said second surrounding groove and which are angularly spaced apart from each other by a plurality of second notches that open toward the winding direction;

a rotation driving unit including a spool assembly sleeved around said first ratchet seat and having a plurality of first guide slots each extending in the left-to-right direction and facing radially said first surrounding groove, and a plurality of first rolling balls each slidably engaged in said first surrounding groove and a respective one of said first guide slots such that said spool assembly is operable to rotate in the unwinding direction to drive rotation of said first ratchet seat in the unwinding direction through said first rolling balls, and such that said spool assembly is rotatable in the winding direction to drive movement of said first rolling balls in said first surrounding groove along the winding direction relative to said first ratchet seat so as not to rotate said first ratchet seat;

a retaining unit including a tubular case immovably retained, sleeved around said second ratchet seat and having a plurality of second guide slots each extending in the left-to-right direction and facing radially said second surrounding groove, and a plurality of second rolling balls each slidably engaged in said second surrounding groove and a respective one of said second guide slots such that said second ratchet seat is rotatable with said first ratchet seat in the unwinding direction to drive movement of said second rolling balls in said second surrounding groove along the unwinding direction relative to said second ratchet seat so as to restrict rotation of said second ratchet seat in the winding direction;

an output unit disposed forwardly of said retaining unit and adapted to be coupled with and rotate the shaft; and a transmission unit coupled with said output unit and operable to be shifted between a transmitting state where a torque generated as a result of the rotation of said unidirectional drive unit is transmitted to said output unit, and a non-transmitting state where the torque is not transmitted.

2. The control device as claimed in claim 1, wherein said first teeth combined contain a first part and a second part, said first part of said first teeth each extending forwardly from a rear side of said first ratchet seat, and said second part of said first teeth each extending rearwardly from a front side of said first ratchet seat, each of said first teeth of said first part being interposed between two adjacent ones of said first teeth of said second part so as to form a first curve path in said first surrounding groove, and wherein said second teeth combined contain a first part and a second part, said first part of said second teeth each extending forwardly from a rear side of said second ratchet seat, and said second part of said second teeth each extending rearwardly from a front side of said second ratchet seat, each of said second teeth of said first part being interposed between two adjacent ones of said second teeth of said second part so as to form a second curve path in said second surrounding groove.

3. The control device as claimed in claim 2, wherein each of said first teeth has a first abutment edge face facing the winding direction and concaved toward the unwinding direction, and a first guiding edge face facing the unwinding direction and inclined along the winding direction and toward an adjacent one of said first teeth, and each of said second teeth has a second abutment edge face facing the winding direction and concaved toward the unwinding direction, and a second guiding edge face facing the unwinding direction and inclined along the winding direction and toward an adjacent one of said second teeth.

4. The control device as claimed in claim 3, wherein each of said first rolling balls is abuttingly engaged with said first abutment edge face of a corresponding one of said first teeth during the rotation of said spool assembly in the unwinding direction so as to rotate said first ratchet seat with said spool assembly, and is guided by said first guiding edge face to roll along said first surrounding groove during the rotation of said spool assembly in the winding direction so as to prevent said first ratchet seat from rotation with said spool assembly, and wherein each of said second rolling balls is movable in a respective one of said second guide slots and along said second surrounding groove during the rotation of said spool assembly in the unwinding direction through guiding by said second guiding edge face of a corresponding one of said second teeth so as to permit the rotation of said second ratchet seat relative to said tubular case, and is abuttingly engaged with said second abutment edge face once a torque is applied to rotate said unidirectional drive unit in the winding direction so as not to be moved along said second surrounding groove, thereby restricting rotation of said second ratchet seat in the winding direction.

5. The control device as claimed in claim 1, wherein said spool assembly includes a spool tube sleeved around said first ratchet seat and having an inner tubular wall which is formed with said first guide slots, a pulling cord coupled to and wound around said spool tube such that said spool tube is rotated in the unwinding direction when said pulling cord is operated to be unwound from said spool tube, and a biasing member disposed to acquire a biasing force for rotation of said spool tube in the winding direction when said pulling cord is unwound.

6. The control device as claimed in claim 1, wherein said unidirectional drive unit includes a transmitting seat coaxially coupled to and rotatable with a front end of said second ratchet seat, said transmission unit including a transmission axle extending along the axis and coupled with said output unit, a coupling sleeve sleeved and retained on said transmission axle to permit said transmission axle to rotate therewith, a control member spaced apart from said coupling sleeve, and a control assembly coupled with said coupling sleeve and said control member, said transmission axle being freely rotatable relative to said transmitting seat to drive said output unit, such that, in response to actuation of said control member, said coupling sleeve is driven through said control assembly to move axially between a coupling position where said coupling sleeve is engaged with said transmitting seat to bring said transmission unit in the transmitting state, and a disengaged position where said coupling sleeve is disengaged from said transmitting seat to bring said transmitting unit in the non-transmitting state.

7. The control device as claimed in claim 6, wherein said transmitting seat has a mating toothed structure projecting forwardly toward said coupling sleeve, said coupling sleeve having a mating toothed structure projecting rearwardly toward said transmitting seat to be in mesh with said mating toothed structure of said transmitting seat when said coupling sleeve is in the coupling position, so as to permit said coupling sleeve and said transmission axle to rotate with said unidirectional drive unit.

8. The control device as claimed in claim 6, wherein said coupling sleeve has a tubular flange extending radially and outwardly, said control assembly including a coupling mount retained to said tubular flange to permit said coupling sleeve to move therewith, a thrust member connected between said control member and said coupling mount such that, in response to actuation of said control member, said coupling sleeve is driven by said coupling mount to move forwardly to the disengaged position, and a biasing member disposed to bias said coupling mount rearwardly to bring said coupling sleeve to the coupling position.

9. The control device as claimed in claim 1, wherein said output unit includes a first actuating seat coupled to be driven by said transmission unit, a second actuating seat disposed forwardly of said first actuating seat, at least one torsion spring sleeved around said first and second actuating seats, and a sleeve member sleeved around said torsion spring and having an inner sleeve surface for said torsion spring to abut thereagainst, each of said first and second actuating seats having a disc portion and a curved portion extending from said disc portion in the left-to-right direction and extending about the axis, said disc portions being spaced apart from each other axially, said curved portions extending axially toward each other to matingly engage with each other during rotation of said transmission unit, said torsion spring surrounding said curved portions and being compressedly disposed inside said sleeve member.

10. The control device as claimed in claim 9, wherein said curved portion of said first actuating seat has a first unwinding edge facing the unwinding direction and a first winding edge facing the winding direction and angularly opposite to said first unwinding edge, and said curved portion of said second actuating seat has a second unwinding edge facing the unwinding direction and said first winding edge, and a second winding edge facing the winding direction and said first unwinding edge and angularly opposite to said second unwinding edge, said torsion spring having a spring end disposed between said first winding edge and said second unwinding edge.

* * * * *